US005206959A

United States Patent [19]

Provenzano

[11] Patent Number: 5,206,959

[45] Date of Patent: May 4, 1993

[54] TOILET DEODORIZER

[76] Inventor: Joseph Provenzano, 1021 E. Gun Hill Rd., Bronx, N.Y. 10469

[21] Appl. No.: 754,443

[22] Filed: Sep. 3, 1991

[51] Int. Cl.[5] ..... E03D 9/02

[52] U.S. Cl. ..... 4/231; D23/208

[58] Field of Search ..... 4/231, 223, 309; D23/208; 422/5, 120, 122

[56] References Cited

U.S. PATENT DOCUMENTS

| | | | |
|---|---|---|---|
| D. 169,349 | 4/1953 | Antritter | D23/208 |
| D. 237,460 | 11/1975 | Bordman | D23/208 |
| 2,011,732 | 8/1935 | Saeks | 4/231 |
| 2,034,619 | 3/1936 | Hoffman | 4/231 |
| 2,984,841 | 5/1961 | Wilson | 4/231 |
| 2,985,377 | 5/1961 | Saeks | 4/231 |
| 3,088,126 | 5/1963 | Klingler | 4/231 |
| 3,217,338 | 11/1965 | Wilson | 4/231 |
| 3,290,699 | 12/1966 | Weinstein | 4/231 |
| 3,604,021 | 9/1971 | Nolte, Jr. | 4/231 |
| 3,947,901 | 4/1976 | Willert | 4/231 |

*Primary Examiner*—William A. Cuchlinski, Jr.

*Assistant Examiner*—John L. Beres

*Attorney, Agent, or Firm*—Charles E. Baxley

[57] ABSTRACT

A toilet deodorizer includes a deodorizer cake and a one-piece plastic framework having two leg portions with lower ends within the cake and extending upwardly therefrom to upper ends that merge with horizontal portions perpendicular to the leg portions. The framework also has a U-shaped portion depending from the horizontal portions. The framework is somewhat springy so that the U-shaped portion can be resiliently flexed away from the leg portions to allow the framework to straddle an upper rim of a toilet bowl with the U-shaped portion on one side of the rim and the leg portions and the cake on the other side of the rim within the toilet bowl. The framework is symmetrical with respect to a plane equidistant from the horizontal portions and parallel thereto. The framework has a top piece or strip member joining the horizontal portions and extending equally therebeyond to free ends. The length of the strip member is about 7 inches (17.8 cm) and the length of the leg portions is about 3 inches (7.6 cm).

4 Claims, 2 Drawing Sheets

TOILET DEODORIZER

BACKGROUND OF THE INVENTION

This invention relates to deodorizers and more particularly to toilet deodorizers.

A widely used toilet deodorizer is disclosed in Wilson U.S. Pat. Nos. 2,984,841 and 3,217,338 of May 23, 1961 and Nov. 16, 1965. Such deodorizer is effective as a deodorizer. It is marketed under the trademark "Bowl Fresh" and comprises a cake of paradichlorobenzene and a one-piece plastic framework having leg portions with free lower ends embedded within the cake and supported thereby. The leg portions extend upwardly from the cake to upper ends that merge with substantially parallel horizontal portions generally at right angles to the leg portions. The widely used deodorizer further comprises a front U-shaped portion depending from the ends of the horizontal portions remote from the leg portions. The leg portions are connected to each other by a generally rectangular member that holds the leg portions a substantially constant distance apart. The framework is of one-piece plastic construction and is somewhat springy so that the U-shaped portion can be resiliently flexed away from the leg portions to allow the U-shaped portion to be passed over the upper rim of a toilet bowl or garbage can or diaper pail to grip the same in resilient and removable fashion with the leg portions and the cake within the toilet bowl.

The widely used deodorizer is symmetrical with respect to a plane equidistant from the horizontal portions and parallel thereto.

However, the widely used deodorizer is subject to the difficulty that it is susceptible to becoming knocked loose from the upper rim of the toilet bowl and from there getting stuck in the toilet trap, causing the toilet to clog and requiring professional removal.

Background prior art patents also include Saeks U.S. Pat. No. 2,985,377 of May 23, 1961 and Willert U.S. Pat. No. 3,947,901 of Apr. 6, 1976.

It is an important object of the present invention to provide a toilet deodorizer that overcomes the problem of the deodorizer falling into the toilet bowl and clogging the toilet.

It is another important object of the invention to provide a toilet deodorizer that solves the aforesaid problem without adding appreciably if at all to the cost of the deodorizer.

The above-mentioned and other objects and advantages of the invention will become apparent hereinafter.

SUMMARY OF THE INVENTION

The invention provides a toilet deodorizer as described above, further including a top piece in the form of a strip member joining the horizontal portions and extending equally therebeyond. The strip member is of plastic material and the inventive toilet deodorizer is preferably of one-piece construction. The length of the strip member may be about 7 inches (17.8 cm).

It has also been found advantageous, in terms of resisting drain clogging, to increase the length of the leg portions to about 3 inches (7.6 cm) from the length of the leg portions in the widely used deodorizer, the length of the leg portions in the widely used deodorizer being about 2.5 inches (6.3 cm).

The manner in which the inventive toilet deodorizer achieves the foregoing objects and advantages will appear hereinafter.

DESCRIPTION OF THE INVENTION

Figure 1:
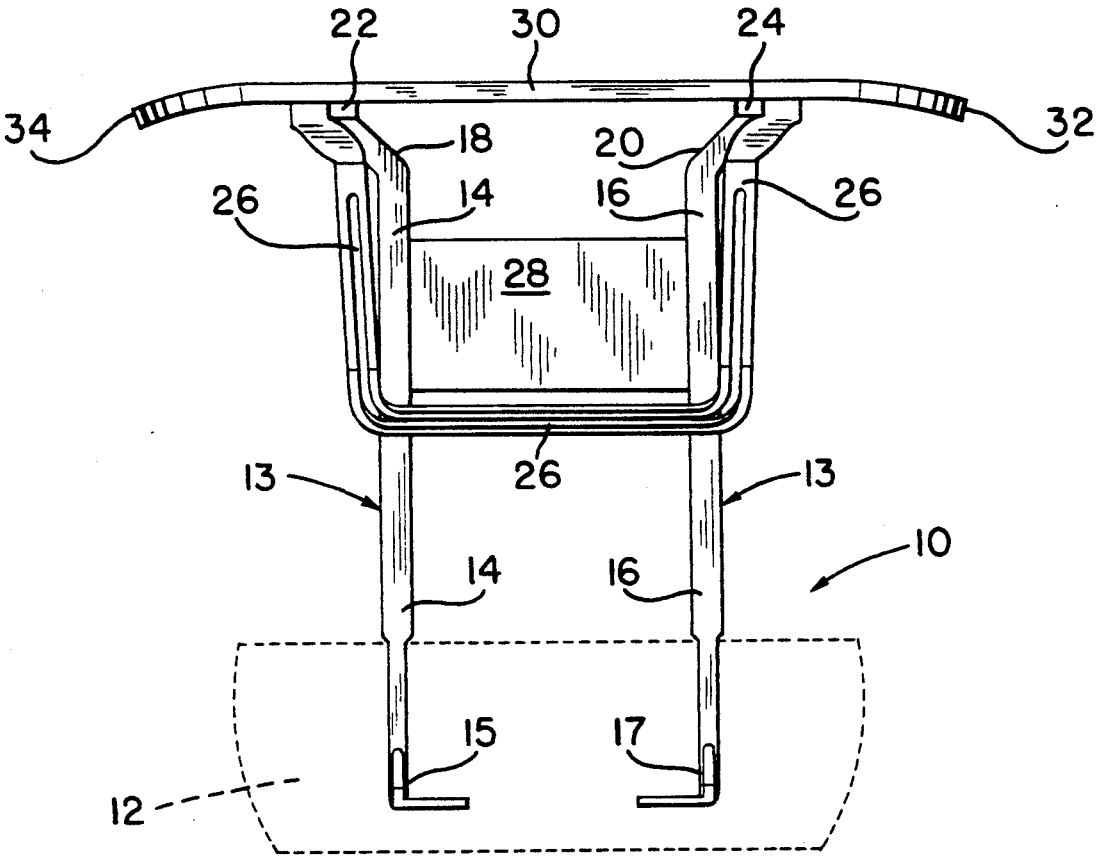
FIG. 1 is a front elevation of a preferred toilet deodorizer embodying the invention as seen from the side thereof which will be outside a toilet bowl.
Figure 2:
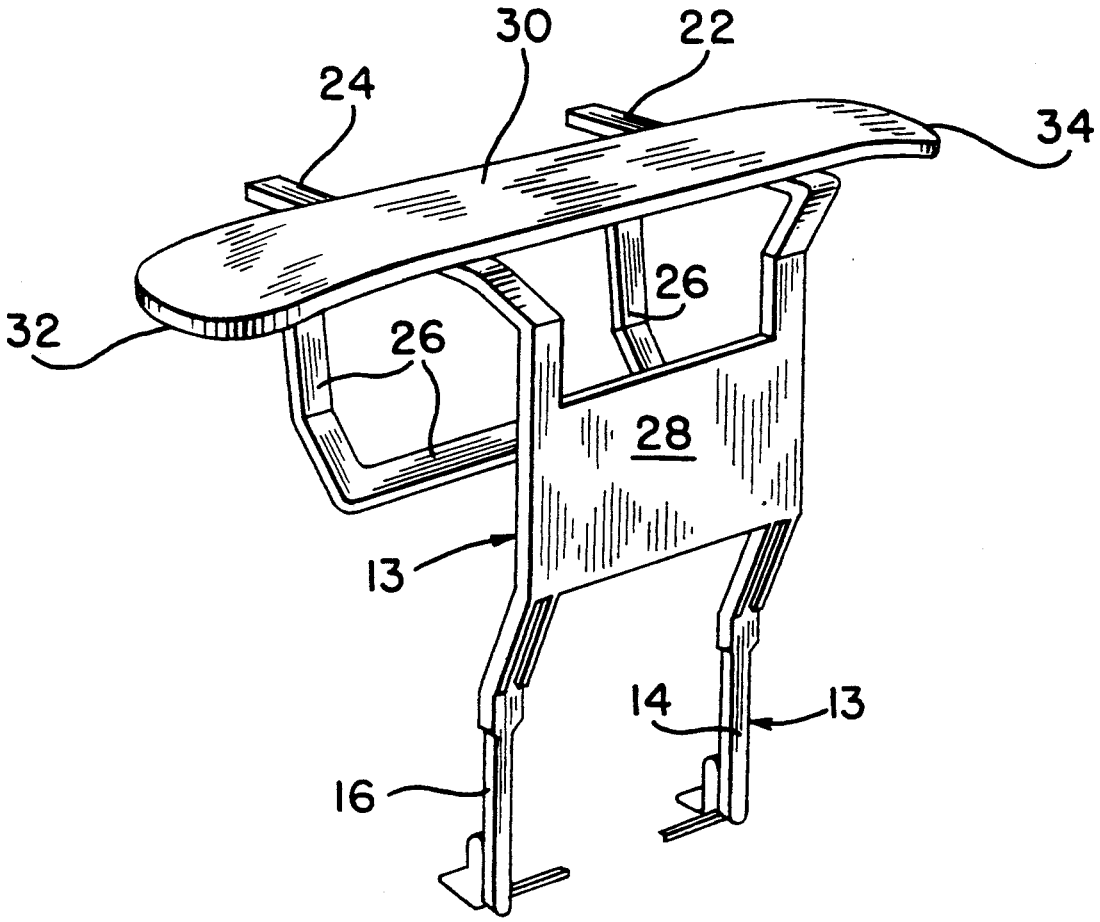
FIG. 2 is a perspective view of the framework of the deodorizer of FIG. 1 as seen from the side thereof which will be inside the toilet bowl.

FIG. 1 shows a toilet deodorizer 10 that is a preferred embodiment of the invention. However, it is to be understood that deodorizer 10 can be used with garbage cans or diaper pails alternatively to toilets, although the need for the device is not so great in the case of garbage cans or diaper pails as it is with toilets, because it is not a catastrophe if the device falls into a garbage can or a diaper pail.

Deodorizer 10 comprises a cake 12 of deodorizing material such as paradichlorobenzene, and a one-piece plastic framework 13 having two largely vertical leg portions 14 and 16 with lower free ends 15 and 17, respectively, within cake 12 and supported thereby. Leg portions 14 and 16 extend upwardly from cake 12 to upper ends 18 and 20, respectively, that merge with substantially parallel horizontal portions 22 and 24, respectively, generally at right angles to leg portions 14 and 16.

Framework 13 also comprises a front U-shaped portion 26 depending from the ends of horizontal portions 22 and 24 remote from leg portions 14 and 16. Leg portions 14 and 16 are connected by a generally rectangular member 28 that holds leg portions 14 and 16 a substantially constant distance apart.

Framework 13 is of one-piece plastic construction and is somewhat springy so that U-shaped portion 26 can be resiliently flexed away from leg portions 14 and 16 to allow U-shaped portion 26 to straddle the upper rim of a toilet (not shown) and to grip the same in resilient and removable fashion with leg portions 14 and 16 and cake 12 within the toilet bowl.

Deodorizer 10 is symmetrical with respect to a plane equidistant from horizontal portions 22 and 24 and parallel thereto.

Deodorizer 10 as described thus far is shown in the aforesaid Wilson U.S. Pat. No. 2,984,841. Framework 13 is also provided with a top piece in the form of a springy strip member 30 joining horizontal portions 22 and 24 and extending equally there-beyond to free ends 32 and 34 which may be bent slightly downwardly resiliently to grip the rim of a toilet bowl. The length of strip member 30 may be about 7 inches (17.8 cm).

Also, the length of leg portions 14 and 16 protruding upwardly from cake 12 (when cake 12 is new) is about 3 inches (7.6 cm), as compared to about 2.5 inches (6.3 cm) in the widely used deodorizer.

If deodorizer 10 should become dislodged from the toilet bowl rim and fall into the toilet, or if deodorizer 10 should simply be dropped in the toilet, no toilet clogging could result, because toilet outlets are approximately 2.5 to 3 inches (6.3 cm to 7.6 cm) in diameter, and strip member 30, in cooperation with the rest of framework 13, including the increased length of leg portions 14 and 16, would prevent clogging.

The invention well attains the stated objects and advantages, among others.

The disclosed details are exemplary only and are not to be taken as limitations on the invention except as those details may be included in the appended claims.

What is claimed is:

1. A deodorizer comprising a deodorizing cake and a one-piece plastic framework having two leg portions with lower ends within said cake and extending upwardly therefrom to upper ends, horizontal portions merging with said upper ends of said leg portions and a U-shaped portion depending from said horizontal portions, said framework being somewhat springy such that said U-shaped portion can be resiliently flexed away from said leg portions to allow said framework to straddle a rim of a container with said U-shaped portion on one side of the rim and said leg portions on the other side of the rim, said framework being symmetrical with respect to a plane equidistant from said horizontal portions and parallel thereto, and said framework further having a strip member joining said horizontal portions and extending equally therebeyond to free ends.

2. A deodorizer according to claim 1 wherein said deodorizer is a toilet deodorizer and said strip member has a length of about 7 inches (17.8 cm).

3. A deodorizer according to claim 1 wherein said free ends of said strip member are angled downwardly.

4. A deodorizer according to claim 2 wherein the length of said leg portions protruding from said cake is about 3 inches (7.6 cm).

* * * * *